United States Patent [19]

Yuji et al.

[11] Patent Number: 4,883,017

[45] Date of Patent: Nov. 28, 1989

[54] DEVELOPING DEVICE

[75] Inventors: Enoguchi Yuji; Natsuhara Toshiya; Yamamoto Masashi, all of Osaka, Japan

[73] Assignee: Minolta Camera Kabushiki Kaisha, Osaka, Japan

[21] Appl. No.: 239,224

[22] Filed: Sep. 1, 1988

[30] Foreign Application Priority Data

Sep. 4, 1987 [JP] Japan ..... 62-222587

[51] Int. Cl.[4] ..... G03G 15/08

[52] U.S. Cl. ..... 118/653; 118/644; 355/259

[58] Field of Search ..... 355/259, 245; 118/656, 118/647, 644, 653

[56] References Cited

U.S. PATENT DOCUMENTS 3,945,723 3/1976 Cook et al. ..... 355/259 X 4,564,285 1/1986 Yasuda et al. ..... 355/259 X

*Primary Examiner*—R. L. Moses

*Attorney, Agent, or Firm*—Burns, Doane, Swecker & Mathis

[57] ABSTRACT

A developing device adjoins a rotatably arranged electrostatic latent image support member, and is internally provided with a rotatably disposed developing roller confronting the electrostatic latent image support member, a cylindrically formed flexible filmy member having a peripheral length being slightly longer than that of the developing roller and loosely mounted around it, a first member for biasing the filmy member against the developing roller to form the slack of the filmy member at a location confronting the electrostatic latent image support member, and a second member for forming a toner layer on an external surface of the filmy member. Wherein, the filmy member has dimensions and a physical property which are satisfied with following equations; $0.05 \leqq E \cdot t^3 \leqq 10$, $2.5 \leqq R \leqq 50$, wherein, E, t and R are, respectively, a modulus of longitudinal elasticity, a thickness and a radius of the filmy member.

11 Claims, 3 Drawing Sheets

DEVELOPING DEVICE

BACKGROUND OF THE INVENTION

1. Field of the Invention

The present invention generally relates to a developing device for use in an electrophotographic copying machine, a printer or the like and more particularly, to a developing device which is capable of steadily providing a uniformly formed thin layer of charged toner with respect to an electrostatic latent image formed on the surface of a photosensitive member or photoreceptor of the copying machine or the like.

2. Description of the related Art

In an electrophotographic or electrostatic copying machine, the surface of a photoreceptor which is of an image support member is preliminarily electrically charged uniformly and is, then, exposed to light on the basis of a pattern corresponding to an image of an original document so that a latent image may be formed thereon. Subsequently, upon supply of the charged toner onto the surface of the photoreceptor having thereon the latent image formed by a developing device, the latent image is developed into a visible toner image and thereafter, the toner image obtained is transferred onto and fixed on a transfer sheet or copy paper sheet.

In the developing device for use in such electrophotographic copying machine or the like, particularly, in the developing device employing therein non-magnetic toner as one-component developer, it is especially important to supply a uniformly formed thin layer of the charged toner onto the surface of the photoreceptor.

Conventionally, U.S. Pat. No. 4,100,884 discloses one of such developing devices, in which upon supply of the non-magnetic toner onto the surface of an elastic developing roller, a blade is pressed against the developing roller so that a thin layer of charged toner may be formed on the peripheral surface thereof and a toner image is, then, formed by bringing the thin layer of the charged toner into direct contact with the surface of the photoreceptor.

In this kind of the developing device, however, to form the thin layer of the charged toner, it is necessary to keep the blade in contact with the surface of the developing roller under a certain pressure greater than a predetermined one. To this end, the developing roller is requested to be relatively high in hardness. On the contrary, it is desirable for the developing roller to be as soft as possible to prevent the photoreceptor from being damaged or the image from being broken on a contact portion between the developing roller and the photoreceptor.

From an above-mentioned point of view, Japanese Patent Laid-open Application No. 55-77764 discloses another developing device in which an electrically conductive thin film is arranged on the surface of a developing roller of an electrically conductive soft elastic foamed member. In this developing device, the toner is caused to electrically adhere to the surface of the developing roller with the use of a magnetic brush and the developing is, the, executed by causing the toner to adhere to an electrostatic latent image through contact between the developing roller and the surface of the photoreceptor.

However, even when the developing roller employing therein the foamed material is used, the pressure between the developing roller and the photoreceptor can not be sufficiently lowered. In particular, in the case where a peripheral speed of the developing roller is to be differentiated from that of the photoreceptor, the image formed on the photoreceptor tends to be disadvantageously spoiled.

Namely, when the pressing force onto the developing roller becomes greater, the force operating in the direction of a sleeve rotation causes the image formed on the photoreceptor to be broken, e.g., cracking and/or deformation of the image, and fogging becomes so much. On one hand, it is not practical to set the pressing force weakened since it becomes impossible that the developing roller is brought into contact with the photoreceptor with uniformly and steadily nipping in a direction along the width of the photoreceptor.

SUMMARY OF THE INVENTION

Accordingly, the present invention has been developed with a view to substantially eliminating the above described disadvantages inherent in the prior art developing device, and has for its essential object to provide an improved developing device, in a toner supply portion of which a developing roller and a blade is kept in contact with each other under a sufficient pressure so that the toner may be charged uniformly and a thin layer thereof may be formed also uniformly.

Another important object of the present invention is to provide a developing device of the above described type which is capable of supplying the toner onto a latent image formed on a photoreceptor of an electrostatic latent image support member by steadily holding the toner in properly soft contact with the photoreceptor at a location thereof confronting the photoreceptor.

In accomplishing these and other objects, according to one preferred embodiment of the present invention, there is provided a developing device disposed adjacently to a rotatably arranged electrostatic latent image support member, and including a rotatably disposed developing roller confronting the electrostatic latent image support member, a cylindrically formed flexible filmy member having a peripheral length being slightly longer than that of the developing roller and loosely mounted there around, first means for bringing the filmy member partly into contact with the developing roller so as to protrude an extra peripheral length portion of the filmy member toward the developing roller so that the extra portion of an external peripheral surface of the filmy member may be brought into contact with the electrostatic latent image support member, and second means for forming a thin layer of charged toner on an external surface of the filmy member brought into contact with the developing roller. In addition, dimensions and a physical property of the filmy member are satisfied with following equation:

$$0.05 \leqq E \cdot t^3 \leqq 10;$$

$$2.5 \leqq R \leqq 50;$$

wherein, E (Kg/mm$^2$), t (mm) and R (mm) are, respectively, a modulus of longitudinal elasticity, a thickness and a radius of the filmy member.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENT

Figure 1:
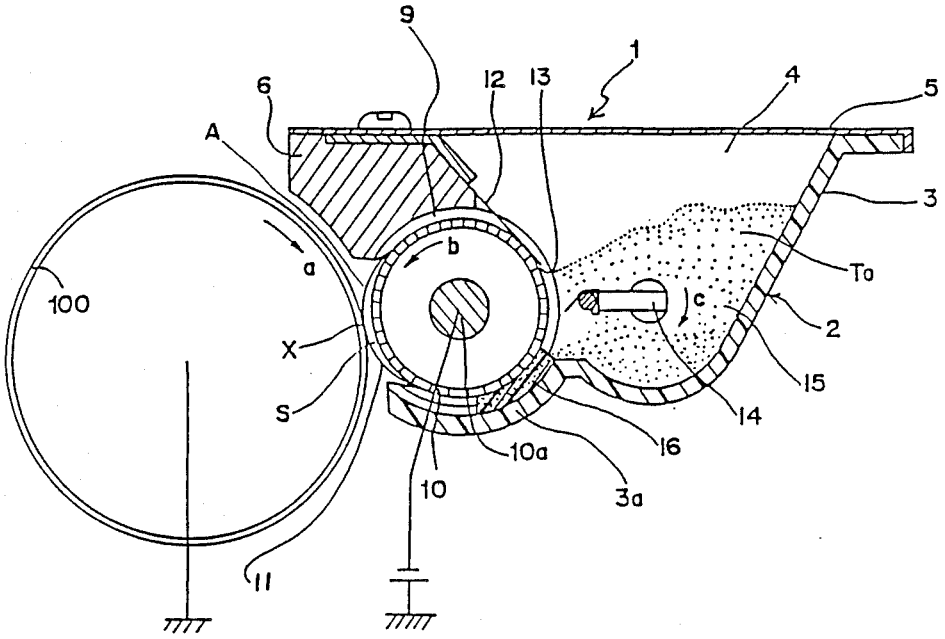
FIG. 1 is a cross-sectional view of a developing device according to an embodiment of the present invention.

Referring now to the drawings, there is shown in FIG. 1, a developing device 1 according to one preferred embodiment of the present invention, which adjoins a photoreceptor drum 100 driven rotatably in the direction as shown by an arrow (a).

The developing device 1 is generally provided with a rotatably arranged developing roller 10, a filmy member 11 loosely mounted around the developing roller 10, a couple of elastic guide pads 9 for biasing the filmy member 11 against the developing roller 10, a blade 12 pressed against the external surface of the filmy member 11 and a developer tank 2 accommodating these members 9, 10, 11 and 12 and storing therein a certain amount of toner To.

The developer tank 2 is substantially composed of a casing 3 disposed at the bottom and rear portions thereof, a couple of side plates 4, a cover 5 and a support member 6 rigidly secured to the forward portion of the cover 5.

The developing roller 10 is formed cylindrically and of an electrically conductive material such as aluminium with a roughened surface by a blasting treatment or the like, with a developing bias voltage Vb being applied thereto. Alternatively, the cylindrically formed developing roller 10 may be of a metallic roller provided, at its external peripheral portion, with an electriaally conductive elastic member of rubber (nitrile rubber, silicone rubber, styrene rubber, butadiene rubber or the like), plastic or the like.

The filmy member 11 is formed also cylindrically and has a peripheral length which is slightly longer than that of the developing roller 10 so as to be loosely mounted therearound. As the filmy member 11, which has flexibility, is used either of a soft resinous sheet, a sheet of such resin including carbon or metallic fine particles or the like, a metallic thin film of nickel, aluminium or the like, or a laminated sheet of the aforementioned resinous sheet and metallic thin film. The above-mentioned materials are available for he material of the filmy member 11, however, it is necessary, as the material of the filmy member 11, that each value of a modulus of longitudinal elasticity, a thickness and a radius of the filmy member 11 is satisfied with a relationship of $0.05 \leqq E \cdot t^3 \leqq 10$ and $2.5 \leqq R \leqq 50$.

Figure 2:
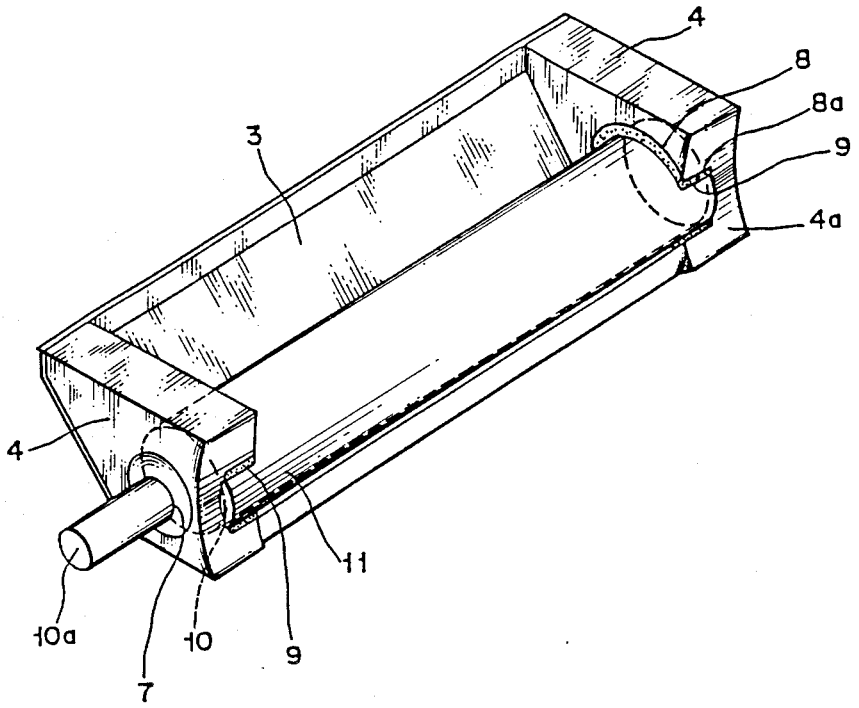
FIG. 2 is a perspective view of a developing roller incorporated into a developer tank in the developing device of FIG. 1.

As shown in FIG. 2, the developing roller 10 loosely mounting the filmy member 11 therearound is provided with a rotary shaft 10*a*, which is inserted into openings 7 defined in the side plates 4 to be rotatably supported thereby, with a driving source (not shown) being drivingly connected to the rotary shaft 10*a*. Both end portions of the developing roller 10 are located in concave portions 8 defined in respective side plates 4. The elastic guide pad 9 is interposed, in each concave portion, between the side plate 4 and each end portion of the filmy member 11 so that the filmy member 11 may be brought into close contact with the external surface of the developing roller 10. The guide pad 9 as the first means for bringing the filmy member into contact with the developing roller has an internal circular surface corresponding to a shape of an external surface for the developing roller, as shown in FIG. 2. On one hand, the concave portion 8 defined in each cover 4 is open on the side of the photoreceptor drum 100, i.e., on the front side 4*a* of the side cover 4, thus resulting in that there exists no guide pad 9 at such portion, in other words, there is an opening portion (A) of the guide pad 9 at such portion.

Accordingly, a portion of the filmy member 11 in contact, on its one side, with the guide pad 9 is brought into close contact, on its other side, with the external surface of the developing roller 10, and the other portion thereof located on the front side 4*a* of the side plate 4 is caused to protrude outwards so that a space (S) may be defined between the filmy member 11 and the developing roller 10. This is because an excessive peripheral portion of the filmy member 11 having the longer periphery than that of the developing roller 10 is collected on such open side of the concave portion 8. Consequently, the protruding portion of the filmy member 11 covering the space (S) is brought into contact, at its external surface, with the peripheral surface of the photoreceptor drum 100.

It is to be noted that the internal circular surface of the guide pad 9 is substantially formed circularly. In other words, it does not matter that the above-mentioned surface is not continuous partly. Moreover, it is acceptable that the guide pad 9 has a shape which causes the filmy member 11 to bring substantially to close contact with the developing roller 10 so that the guide pad 9 may be uniformly pressed against the filmy member 11 as well as a friction coefficient between the guide pad 9 and the filmy member 11 becomes lower. For example, it is applicable as the guide pad 9 that the guide pad 9 comprises an elastic multiple sheet of a foamed polyurethane having a polyester sheet on its surface, which is adhered to the internal surface of the guide pad 9. The following design as another means for bringing the filmy member 11 into close contact with the developing roller is available. Namely, in the case where a filmy member comprises either of a magnetic material or a material containing a magnetic article, the above-mentioned means is so designed that this filmy member is attracted onto the external surface of the developing roller 10 by a magnetic attraction force generated by a magnet or the like. It is also acceptable that any other means has a shape causing the filmy member 11 to be brought into close contact with the developing roller 10 as well as a shape causing to collect the excessive peripheral portion of the filmy member 11 at the opening portion (A) of the guide pad 9, which is confronted with the photoreceptor drum 100.

Further, it is to be noted here that the guide pad 9, the developing roller 10 and the filmy member 11 have been selected to satisfy a relationship of $\mu 1 > \mu 2$, where a dynamic coefficient of friction between the external surface of the developing roller 10 and the internal surface of the filmy member 11 is $\mu 1$, and that between the external surface of the filmy member 11 and the guide pad 9 is $\mu 2$. Accordingly, when the developing roller 10 is caused to rotate in the direction as shown by an arrow (b), the filmy member 11 rotates together with the rotation of the developing roller 10 without any slip between the two.

Furthermore, the blade 12 is arranged as a member for forming the thin layer of toner. The blade 12 having, at this forward end, a flexible sheet, for example, of Teflon (name used in trade and manufactured by Du Pont), nylon or the like is securely mounted on the rear side of the support member 6 provided immediately above the developing roller 10. The blade 12 resiliently presses the developing roller 10 through the filmy member 11 at an oblique upper portion on the rear side thereof. The wellknown means in the prior art, such as a pressing roller or anything else as the like, is applicable to the thin layer forming member as described above. A toner levelling pad 16 is mounted on a portion 3*a* of the casing 3 of the developer tank 2 confronting the developing roller 10 and presses the surface of the filmy member 11 onto the external surface of developing roller 10.

A toner storing compartment 15 is formed at the rear portion of the developer tank 2 and is internally provided with an agitator 14 disposed rotatably in the direction as shown by an arrow (c). The agitator 14 functions to agitate the toner To stored in the toner storing compartment 15 in the direction as shown by the arrow (c) for prevention of blocking thereof.

The operation of the developing device 1 having the above described construction will explains hereinafter.

On condition that the developing roller 10 and the agitator 14 are caused to rotate by a driving source (not shown) respectively in the directions as shown by the arrows (b) and (c), the toner To accommodated within the toner storing compartment 15 is forcibly moved in the direction as shown by the arrow (c) under an effect of stirring by the agitator 14.

Meanwhile, the filmy member 11 is driven to rotate together with he developing roller 10 in the direction as shown by the arrow (b) under the influence of frictional force exerting between it and the developing roller 10, thus resulting in that the toner To in the developer tank 2 in contact with the filmy member 11 is transported in the direction of rotation of the filmy member 11 by the action of electrostatic force. When the toner To is caught in a V-shaped taking-in portion 13 formed between the filmy member 11 and the forward portion of the blade 12 and reaches a pressure portion between the filmy member 11 and the blade 12, the toner To is spread uniformly in the form of a thin layer on the surface of the filmy member 11 and charged positively or negatively through the friction therewith.

When the thinly layered toner To held on the filmy member 11 under the influence of the electrostatic force caused by the charged toner itself reaches a developing region X confronting the photoreceptor drum 100 in compliance with the movement of the filmy member 11 following the developing roller 10, the toner To is caused to move to an electrostatic latent image formed on the surface of the photoreceptor drum 100 by an electric field in accordance with a voltage difference between a surface voltage of the photoreceptor drum 100 and the bias voltage applied to the developing roller 10 and is caused to form a toner image.

Since the filmy member 11 in contact with the photoreceptor drum 100 is never brought into contact with the developing roller due to the existence of the space (S), the filmy member 11 softly and uniformly comes in contact with the photoreceptor drum 100 by means of its proper rigidity by which its desirable shape is kept through its suitable nip width due to the space (S) existing between the filmy member 11 and the developing roller 10 as described previously so that the latent image formed on the photoreceptor drum 100 may be turned to the uniformly toner image. It is effective for preventing a fog in a non-image portion that a peripheral speed of the photoreceptor drum 100 is caused to differ from that of the filmy member 11, and thus resulting in that the toner image once formed on the photoreceptor drum 100 can never be broken by a physical force such as a sliding friction force o the like caused by the filmy member 11.

The toner To having passed the developing region X is successively transported, together with the filmy member 11, in the direction as shown by the arrow (b). When the toner To passes between the toner levelling pad 16 and the filmy member 11, an image pattern from which the toner To has already been consumed in the developing region X is erased so that the uniformity of the toner layer remained on the surface may be obtained.

Furthermore, the toner To is supplied to the surface of the filmy member 11 by the rotating agitator 14 again. Consequently, the thin layer of the charged toner is uniformly formed again on the surface of the filmy member 11 at the pressure portion of the blade 12 and, the aforementioned operation is repeated thereafter.

In the next place, results of the experiments 1 and 2, and the comparison experiments 1 and 2 will be explained hereinafter, in which developing devices having the filmy members made, respectively, of various kinds of materials are used.

Before explaining the respective experiments, at first, results of an experiment on the filmy member which is used to the developing device according to the embodiment to which the present invention is applicable are disclosed hereinafter. A purpose of this experiment is to obtain a suitable relationship between a pressing force (g/mm) and a dimension of a radius of the filmy member 11 which has been loosely mounted around the developing roller 10, where the pressing force is a force per unit length, which is acting on the developing roller and also is given by an equation described later on.

Figure 3:
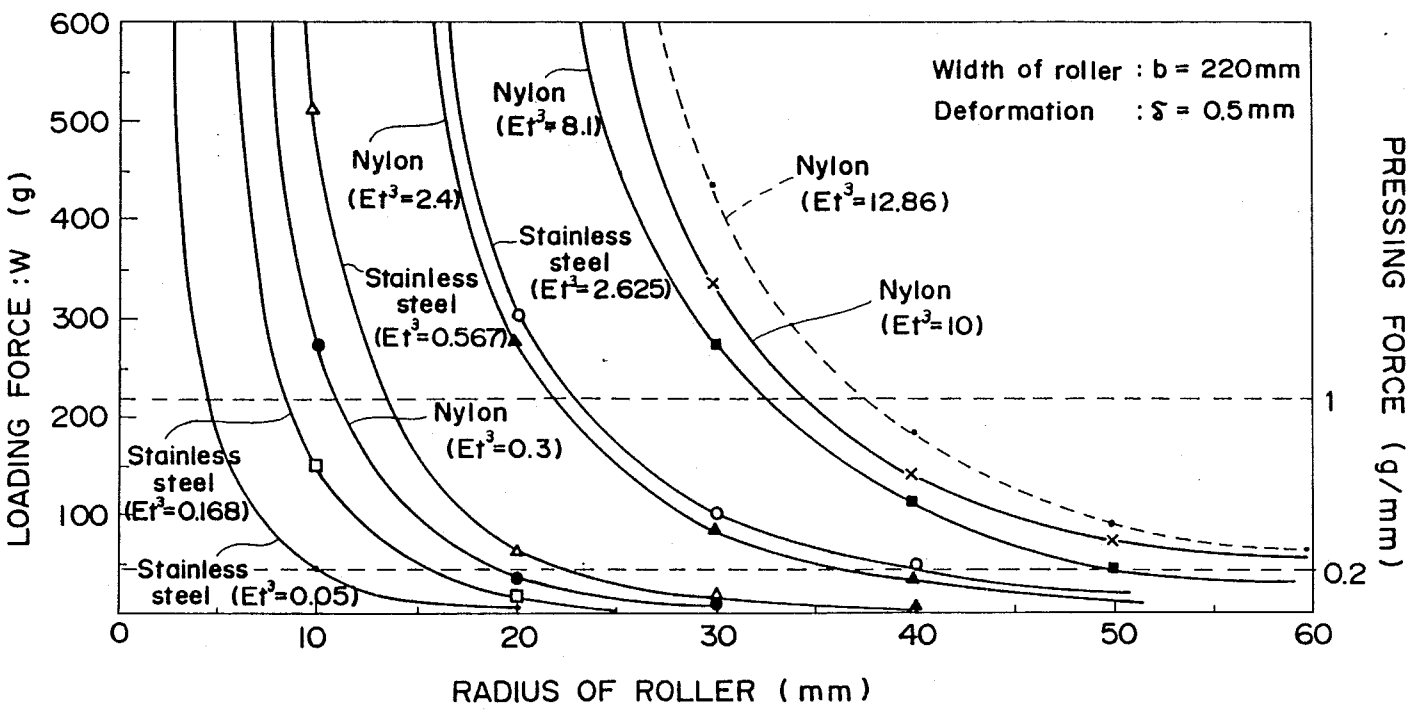
FIG. 3 is a diagram showing a relationship between a radius of a filmy member and a pressing force on respective values of "$E \cdot t^3$" which are used as a parameter.

Referring now to FIG. 3, there is shown a graph about the above-mentioned relationship which changes depending on what material and how thick is the filmy member. Respective curves in the drawing are drawn with respective parameters, i.e., a value of "$E \cdot t^3$", wherein "E" means a modulus of longitudinal elasticity of the used material, and "t" means a thickness of the used material. In these experiments, the filmy members are made of a nylon and a stainless steel, respectively. In FIG. 3, the curve having either mark of ●, ▲, or ■ represents the nylon made filmy member, and the respective marks represent filmy members in different thickness, i.e., ● :0.1, ▲ :0.2 and ■ :0.3 mm. Similarly, the curve having either marks of □, △ or ○ represents the stainless steel made filmy member and each mark of □ △ and ○ means 0.02, 0.03 and 0.05 mm in thickness, respectively. Besides, a couple of additional curves are drawn in the drawing.

According to the drawing of FIG. 3, in the case where the values of "$E \cdot t^3$" is smaller than 0.05, a pressing force to be required can not be obtained when the radius of the developing roller is set within a range (2.5–50 mm in radius) of practical dimensions for the developing roller 10. On the contrary to the above, a pressing force which acts on the photoreceptor drum becomes too strong when its radius is set within the above-mentioned range, in the case where the value of "$E \cdot t^3$" is larger than 10. If the pressing force to be required in minimum can not be obtained, it is not possible to bring the thin layer of the toner formed on the filmy member into contact with the photoreceptor drum through its sufficient nip width, thus resulting in that uniform as well as sufficient density of a printed image can not be obtained. If the pressing force is too weak, inferiority of the printed image such as partly lacking of the printed image, a fog in the non-image portion and the like appears in the case where, especially, the speed difference exists between the photoreceptor drum and the filmy member.

As it would become apparent from FIG. 3 in the result, in the practical range (2.5–50 mm) of the radius of the developing roller, a suitable pressing force (0.2–1 g/mm) can be obtained when the value of "$E \cdot t^3$" is defined within the range of $0.05\ E \cdot t^3 \leqq 10$. This result has nothing to do with a kind of a material and a thickness of a material about members.

It is to be noted here that the modulus: E (kg/mm$^2$) of longitudinal elasticity of typical materials of the filmy member, being applicable to the embodiment therein, are listed below.

| Material | Modulus of elasticity |
|---|---|
| Polyester | 230 |
| Polypropylene | 120–170 |
| Nylon | 300–350 |
| ETFE | 150 |
| Phenol Resin | 800 |
| Phosphor Bronze | 12,000 |
| Steel | 21,000 |
| Spring steel | 21,500 |
| Nickel | 20,900 |

CONDITIONS AND RESULTS OF EXPERIMENT 1

(a) Experimental Conditions (1) Filmy member 11;
Material: Nickel electroformed film
Modulus of longitudinal elasticity E:
$2.1 \times 10^4$ kg/mm$^2$
Dimensions (thickness (t) × width (b)):
40 μm × 220 mm
Value of $E \cdot t^3$: 1.34
Surface roughness:
5 μm in 10-points average roughness (Rz) of JIS (Japanese Industrial Standard)
Code No.: B 0601

The filmy member having the above-mentioned property was cylindrically formed (25 mm at an inside diameter), and it was loosely mounted around a driving roller (developing roller 10). A developing sleeve comprising the above two was formed thus.

(2) Developing roller 10 (driving roller as described above) had a coated rubber layer with an electrical conductivity on its external surface and this outer diameter was 24.5 mm and hardness of the coated rubber was 40°.

Figure 4:
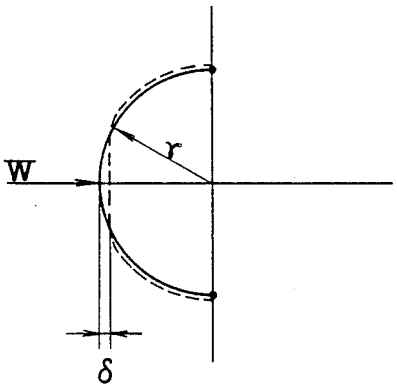
FIG. 4 is an explanatory view showing a state of a cylindrically formed filmy member in operation.

(3) Blade 12;
Material: Silicon rubber
Hardness: 50°
Thickness: 1.6 mm (4) Thin layer of the charged toner on the filmy member 11;
Toner density: 0.5 mg/cm$^2$
Thickness: 20 μm
Elecrostatic charge potential: +20 μC/g
(5) Toner to be used;
Type: positive type toner
Material: styrene-acrylate resin
Average particle diameter: 13 μm Under the above-mentioned conditions, developing was executed. At the same time, Vi (an electric potential at an image portion) = −400 V for an electrostatic latent image on the photoreceptor drum 100 and a voltage −200 V for a developing bias voltage were, respectively, applied to the photoreceptor drum 100 and the developing roller 10 (the driving roller). The slack of the filmy member 11 was caused to confront the photoreceptor drum 100 so that the slack might be brought into contact with the external surface of the photoreceptor drum 100 at a contact point where the slack of the filmy member 11 was pushed back in 0.5 mm (δ) long against the drum surface (refer to FIG. 4). That is, a deformation amount (δ) of the slack of the filmy member at the contact point on the drum surface was 0.5 mm in operation. Under such condition, the filmy member 11 was caused to rotate at its speed which was three times as fast as a speed of the photoreceptor drum 100, i.e., the rotating speed of the filmy member 11: the rotating speed of the photoreceptor drum 100 = 3:1 (this speed difference $\theta$ is defined as $\theta = 3$ hereinafter).

(b) Experimental Results

The filmy member 11 was caused to rotate at that speed, as maintaining such contact-developing, thus resulting in that there were no fog in the non-image portion and no partially lacking of a printed image and degradation about a horizontal fine line or the like, and the printed image having sufficient density (I.D. = 1.3) on a picture image could be obtained.

It is to be noted here that a loading force operating on the photoreceptor drum 100 is given by the following equation, assuming that the loading force is defined as W and the filmy member mounted around the developing sleeve is rigidly supported at its both ends.

$$W = \frac{384 \cdot E \cdot b \cdot t^3 \cdot \delta}{12 \cdot (\pi r)^3} = 83.204\ (g)$$

Then, it could be obtained that the calculated pressing force was 0.378 (g/mm). It is presumed that the pressing force being within a suitable range of a pressing force (0.2–1.0 g/mm) is acting on the external surface of the photoreceptor drum 100.

CONDITIONS AND RESULTS OF EXPERIMENT 2

(a) Experimental Conditions (1) Filmy member 11;
Material: Extruded formed nylon tube
Modulus of longitudinal elasticity E:
$0.03 \times 10^4$ kg/mm$^2$
Dimensions (Thickness (t) × Width (w) × Inside Dia.):
180 μm × 220 mm × 25 mm
Value of "$E \cdot t^3$": 1.74
(2) Others: Same as Experiment 1

Further, the above-mentioned nylon tube contains carbon particles and has electrical conductivity. The nylon tube was so designed that its surface resistance was approximately $10^4$ Ω cm in average.

(b) Experimental Results

As similar to the aforegoing Experiment 2, the contact-developing at the speed difference $\theta=3$ was carried out. At that time, a printed image with sufficient satisfaction could be obtained, similarly to that of Experiment 1. In addition, a loading force: W according to the above-mentioned equation was 108.314 (g), and a pressing force became 0.49 (g/mm).

COMPARISON EXPERIMENT 1

In this experiment, the filmy member 11 to be used was similar to the member which was used in the aforegoing Experiment 2. However, thickness of the nylon tube, in this experiment, changed from 180 μm to 350 μm, and a value of $E \cdot t^3$ became 12.86, accordingly. Other conditions except the above was completely same as that of Experiment 2. Under such conditions, the contact-developing was carried out. At that time when the contact-developing was carried out with the speed difference $\theta=3$, a pressing force acting on the contact surface became so much that a large amount of fog in a non-image portion appeared as well as a printed image on a paper became inferior due to rubbing created by the speed difference at the contact surface between the filmy member 11 and the photoreceptor drum 100, thus resulting in that a horizontal fine line could be hardly reappeared.

At this time, the calculated loading force: W was 796.29 (g), and a pressing force per unit length became 3.61 (g/mm).

COMPARISON EXPERIMENT 2

In this experiment, a new filmy member and a driving roller was designed.

(1) Filmy member 11

Material: Extruded formed nylon tube

Dimensions (Thickness (t)×Inside Dia.):

350 μm×60 mm

Value of $E \cdot t^3$:12.86

(2) Driving roller 10

Dimension of Outer Dia.: 59 mm

The filmy member 11 was mounted around the driving roller 10. With these members and under same conditions as the aforegoing experiments, the contact-developing was carried out. At that time when the contact-developing was carried out with the speed difference $\theta=3$, the pressing force was proper, however, the developing device became large so that it was not preferable in practice.

At this time, the calculated loading force: W was 56.8 (g), and the pressing force per unit length became 0.25 (g/mm).

As clearly described so far, in the developing device according to the present invention, in a toner supply portion where the toner is spread on the surface of the filmy member, since the filmy member is kept in close contact with the developing roller, a thin layer forming member ca be brought into steady contact with the filmy member, even when a blade is used as the thin layer forming member. Accordingly, in the toner supply portion, since the blade can be pressed against the filmy member under sufficient pressure, electrostatic potential of the charged toner can be raised up to a desirable value, thereby enabling the thin layer of the toner to be formed uniformly.

On one hand, in a developing region, since the filmy member is kept in stable and accurate contact with the photoreceptor drum by a suitable low pressing force so that the toner may be uniformly supplied onto the electrostatic latent image, the printed image having steady uniform density can be obtained.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A developing device disposed adjacently to a rotatably arranged electrostatic latent image support member, which comprises:

a rotatably disposed developing roller confronting said electrostatic latent image support member;

a cylindrically formed flexible filmy member having a peripheral length being slightly longer than that of said developing roller and loosely mounted therearound;

first means for bringing said filmy member partly into close contact with said developing roller so as to protrude an extra peripheral length portion of said filmy member toward said developing roller so that said extra portion of an external peripheral surface of said filmy member may be brought into contact with said electrostatic latent image support member; and second means for forming a thin layer of charged toner on the external surface of said filmy member brought into contact with said developing roller, dimensions and a physical property of said filmy member being satisfied with following equations:

$$0.05 \leqq E \cdot t^3 \leqq 10;$$

$$2.5 \leqq R \leqq 50;$$

wherein, E ($kg/mm^2$) is a modulus of longitudinal elasticity and t (mm) is a thickness and R (mm) is a radius.

2. A developing device as claimed in claim 1, wherein a circumferential speed of said filmy member is different from that of said electrostatic latent image support member.

3. A developing device as claimed in claim 2, wherein said circumferential speed of said filmy member is faster than that of said electrostatic latent image support member.

4. A developing device as claimed in claim 1, wherein, said filmy member is made of one of a resinous sheet, a resinous sheet with an additive material which is carbon powder, a resinous sheet with additive materials which are carbon powder and fine metallic particles and a resinous sheet with a additive material which is fine metallic particles.

5. A developing device as claimed in claim 1, wherein said filmy member is made of a filmy metal sheet.

6. A developing device as claimed in claim 1, wherein said filmy member is made of a laminated sheet comprising said filmy member as claimed in claim 4 and said filmy member as claimed in claim 5.

7. A developing device as claimed in claim 1, wherein said first means has an internal circular surface which is corresponding a shape of an external peripheral surface of said developing roller.

8. A developing device as claimed in claim 1, wherein said first means is made of a foamed resinous material.

9. A developing device as claimed in claim 1, wherein said first means is made of a laminated material comprising a foamed resinous material and a resinous sheet material.

10. A developing device as claimed in claim 1, wherein said developing roller, said filmy member and said first means are selected to satisfy a relationship of $\mu 1 > \mu 2$, where a dynamic coefficient of friction between the external surface of said developing roller and the internal surface of said filmy member is $\mu 1$, and that between the external surface of said filmy member and a surface of said first means facing the external surface of said filmy member is $\mu 2$.

11. A developing device disposed adjacently to a rotatably arranged photosensitive member, in which non-magnetic one-component developer is employed, which comprises:

a rotatably disposed developing roller confronting said photosensitive member;

a cylindrically formed flexible filmy member having a peripheral length being slightly longer than that of said developing roller and loosely mounted therearound;

first means for bringing said filmy member partly into close contact with said developing roller so as to protrude an extra peripheral length portion of said filmy member toward said developing roller so that said extra portion of an external peripheral surface of the filmy member may be brought into contact with said photosensitive member; and second means for forming a thin layer of charged toner on the external surface of said filmy member brought into contact with said developing roller, dimentions and a physical property of said filmy member being satisfied with following equations:

$$0.05 \leqq E \cdot t^3 \leqq 10;$$

$$2.5 \leqq R \leqq 50;$$

wherein, E (kg/mm$^2$) is a modulus of longitudinal elasticity and t (mm) is a thickness and R (mm) is a radius.

* * * * *

UNITED STATES PATENT AND TRADEMARK OFFICE

CERTIFICATE OF CORRECTION

PATENT NO. : 4,883,017

DATED : November 28, 1989

INVENTOR(S) : Yuji ENOGUCHI, et al.

It is certified that error appears in the above-identified patent and that said Letters Patent is hereby corrected as shown below:

Title page:

[75] Inventors: Yuji ENOGUCHI; Toshiya NATSUHARA; Masashi YAMAMOTO, all of Osaka, Japan Signed and Sealed this Thirtieth Day of July, 1991

*Attest:*

HARRY F. MANBECK, JR.

*Attesting Officer*

*Commissioner of Patents and Trademarks*